United States Patent [19]

Brabant

[11] Patent Number: 4,930,838

[45] Date of Patent: Jun. 5, 1990

[54] PORTABLE STADIUM SEAT WITH EXTENSIBLE AND RETRACTABLE RAIN COVER

[76] Inventor: Omer E. Brabant, 2929 NE. 49th St., Fort Lauderdale, Fla. 33308

[21] Appl. No.: 374,773

[22] Filed: Jun. 3, 1989

[51] Int. Cl.[5] ..... A47C 7/66

[52] U.S. Cl. ..... 297/184; 297/191

[58] Field of Search ..... 297/191, 184, 252, 352, 297/378, 379

[56] References Cited

U.S. PATENT DOCUMENTS

| | | | |
|---|---|---|---|
| 73,313 | 1/1868 | Estes | 297/184 |
| 1,256,902 | 2/1918 | Howe | 297/184 |
| 1,451,532 | 4/1923 | Buchner | 297/184 |
| 1,655,860 | 1/1928 | Engquist | 297/191 |
| 1,903,579 | 4/1933 | Taylor | 297/184 |
| 2,929,587 | 3/1960 | Martin | 297/184 |
| 3,066,980 | 12/1962 | Clute | 297/252 |
| 3,594,039 | 7/1971 | Harp | 297/252 |
| 3,884,523 | 5/1975 | Allen | 297/184 |
| 4,118,066 | 10/1978 | Ricke | 297/184 |
| 4,320,922 | 3/1982 | Meritis | 297/184 |
| 4,781,411 | 11/1988 | Kolb | 297/184 |
| 4,788,997 | 12/1988 | Clopton | 135/117 |

*Primary Examiner*—Peter R. Brown

*Attorney, Agent, or Firm*—Oltman and Flynn

[57] ABSTRACT

A portable foldable stadium seat storing a roll-down rain cover. The stadium seat has a back structure pivoted to a bottom seat member and presenting front and rear members spaced apart front-to-back by laterally spaced legs of the frame of the back structure. A spring-wound, window shade-type roller is rotatably mounted between these frame legs below the front and rear members of the back structure. A folded fabric rain cover is wound on the roller and extends up between the front and rear members and the laterally spaced legs of the frame of the back structure. A stick extends through a loop at the upper end of the rain cover and engages upwardly-facing shoulders on the legs of the frame when the rain cover is wound on the roller. A manually operable brake holds the roller against rotation after the rain cover is unwound and pulled up to a raised position above the back structure.

8 Claims, 2 Drawing Sheets

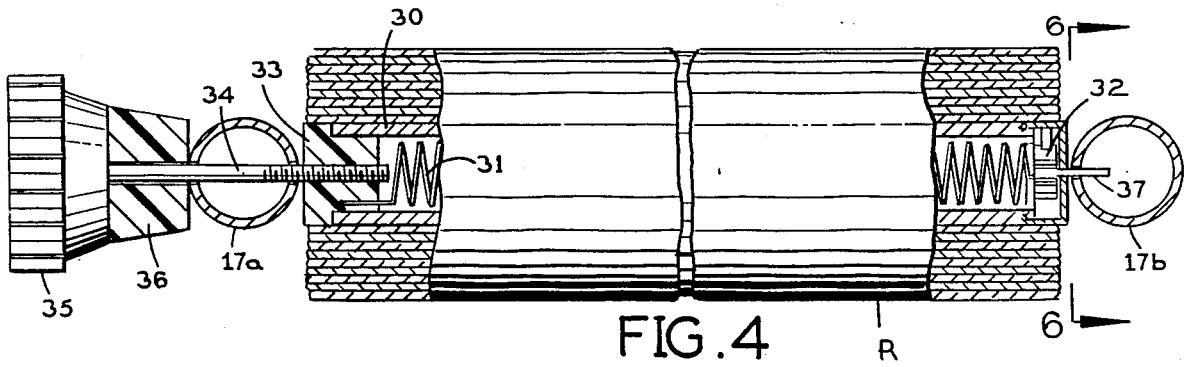
FIG. 4
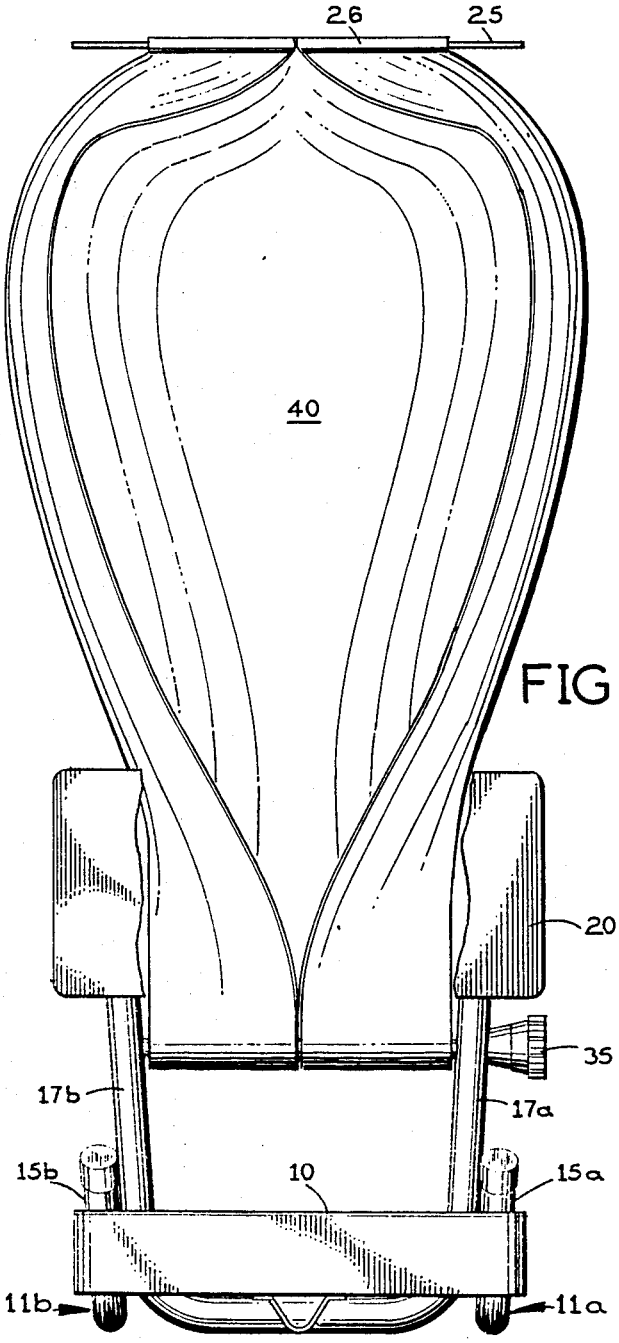
FIG. 8
FIG. 6
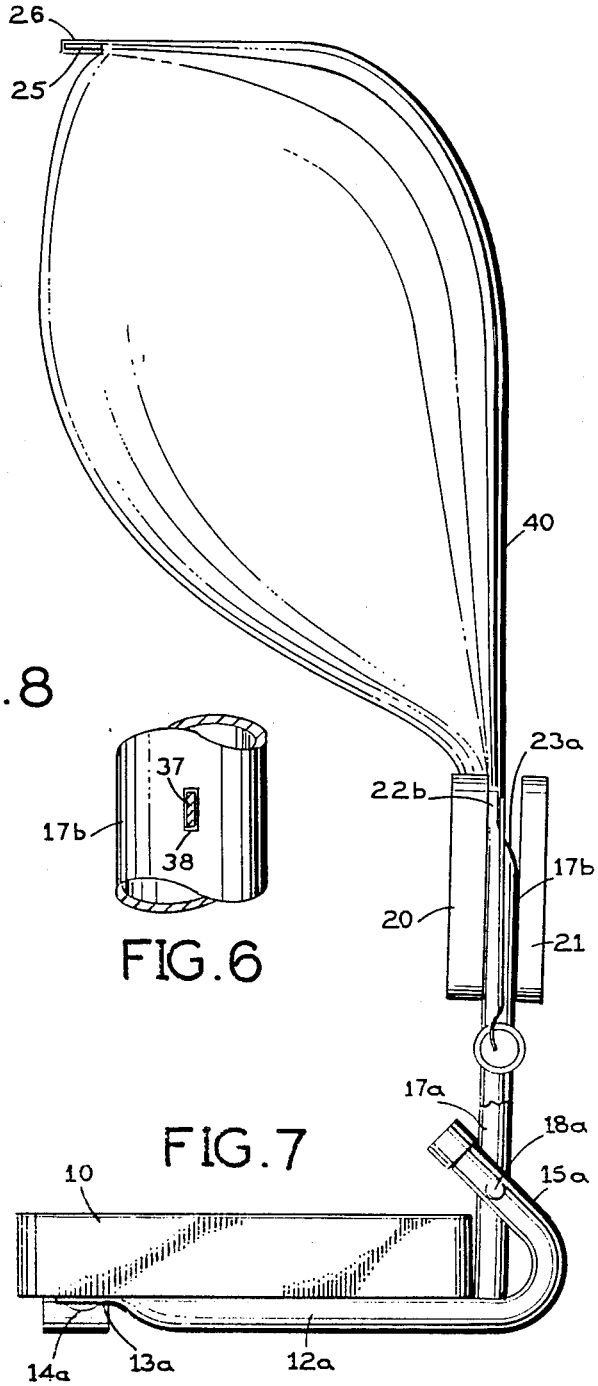
FIG. 7

PORTABLE STADIUM SEAT WITH EXTENSIBLE AND RETRACTABLE RAIN COVER

SUMMARY OF THE INVENTION

This invention relates to a portable stadium seat with an extensible and retractable roll-down rain cover.

Portable foldable stadium seats are used by many spectators in grandstands or stadiums where the seats are backless.

The present invention is directed to a stadium seat of this general type which is equipped with a flexible rain cover that is rolled down in a convenient, unobstructive location in the stadium seat when not needed to protect the user from rain and may be unrolled, when needed, to a raised position covering the head and upper body of a person sitting on the stadium seat.

A principal object of this invention is to provide a novel portable stadium seat which stores a flexible rain cover that, when needed, may be raised to cover the head and upper body of a person using the seat.

Preferably, the present invention has a spring-powered roller in the back frame of a fold-up stadium seat and a flexible, thin, waterproof fabric rain cover that normally is wound snugly around this roller. The rain cover may be unwound and pulled up from the roller (while remaining attached at its lower end to the roller) to cover the head and upper body of a person sitting on the stadium seat. A manually operated brake may be applied to hold the rain cover in its raised, unwound position and prevent the spring-powered roller from retracting it to its normal condition wound on the roller. When the rain cover is no longer needed, the brake is released and the roller winds the rain cover down to ots stored, retracted position.

Further objects and advantages of this invention will be apparent from the following detailed description of a presently preferred embodiment which is illustrated schematically in the accompanying drawings.

DESCRIPTION OF THE DRAWINGS

FIG. 4 is a view taken along the line 4—4 in FIG. 2, partly in elevation and partly in section, showing the rain cover rolled down on the roller;

FIG. 6 is a view taken along the line 6—6 in FIG. 4;

FIG. 7 is a side elevation like FIG. 3 but with the rain cover raised; and FIG. 8 is a front elevation of the stadium seat with the rain cover raised.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
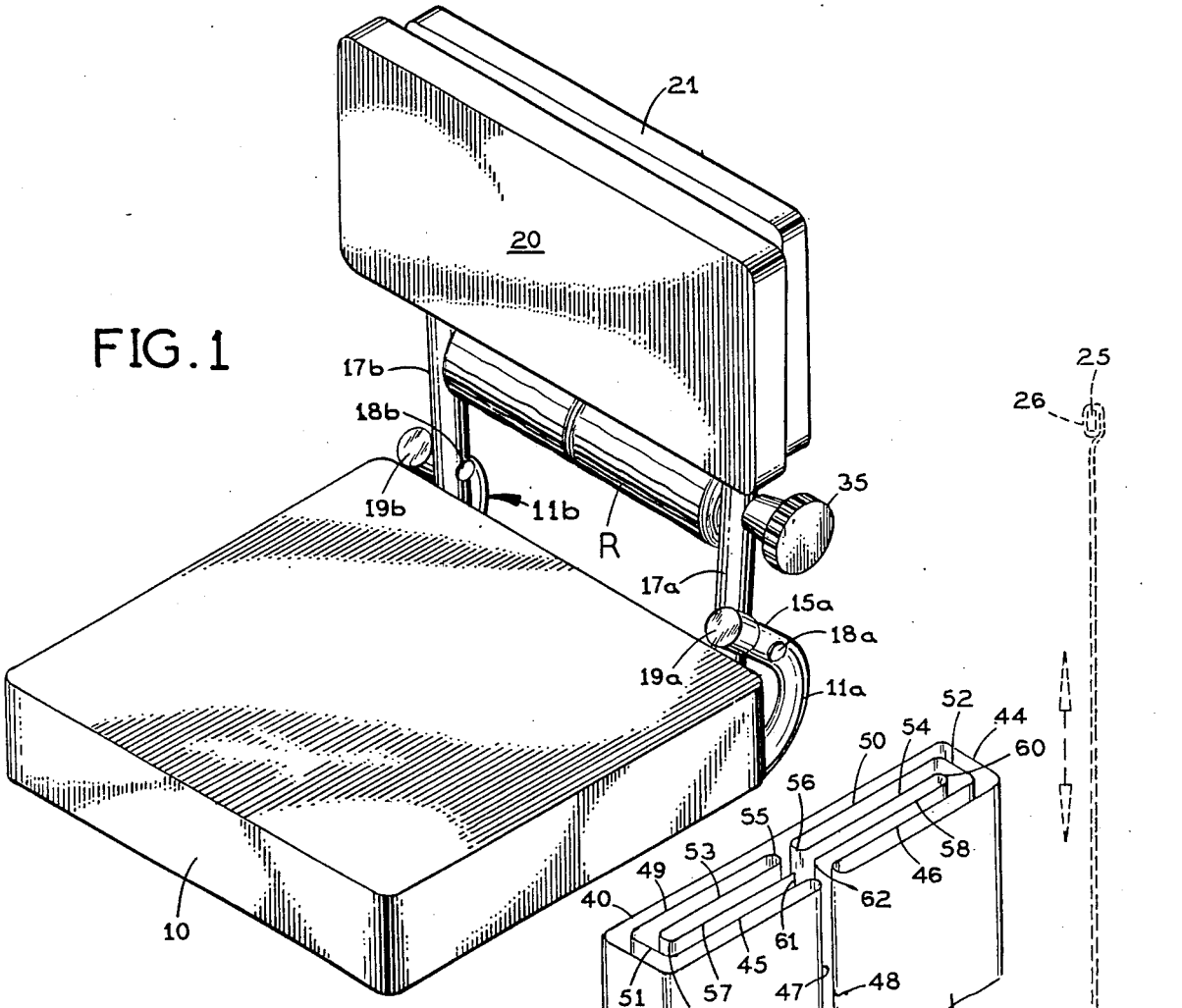
FIG. 1 is a front perspective view of a stadium seat embodying the present invention.

Referring to FIG. 1, the present stadium seat has a seat cushion 10 of known design and a pair of identical tubular bottom frame pieces 11*a* and 11*b*.

Figure 3:
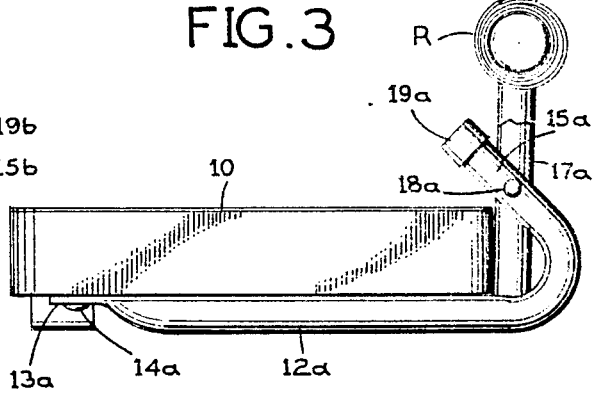
FIG. 3 is a side elevation of the stadium seat taken from its right end in FIG. 1 and showing the rain cover retracted in full lines and extended in phantom.

As shown in FIG. 3, bottom frame piece 11*a* has a tubular bottom segment 12*a* extending from back to front directly beneath seat cushion 10 near its left edge (looking forward). The front end of segment 12*a* is flattened as shown at 13*a* in FIG. 3 and is attached by a screw 14*a* to the bottom of seat cushion 10. Segment 12*a* is attached to the bottom of seat cushion 10 by additional fastening elements (not shown) toward its back end. At the back end of its bottom segment 12*a*, the bottom frame piece 11*a* is bent upward and forward through an angle greater than 90 degrees, providing an upwardly and forwardly inclined, tubular, upper segment 15*a* (FIG. 3) that extends over the top of seat cushion 10 near its back edge.

The other bottom frame member 11*b* is located near the right edge (looking forward) of seat cushion 10. Elements of frame member 11*b* which correspond to those of frame member 11*a* are given the same reference numerals but with a "b" suffix instead of an "a" suffix.

The stadium seat has a back structure with a U-shaped frame 16 (FIG. 2) having a tubular left leg 17*a* and a tubular right leg 17*b* joined to the opposite ends of a tubular straight bottom segment 18. As best seen in FIG. 3, the left leg 17*a* of the back frame is pivotally connected at 18*a* to the upper segment 15*a* of the bottom frame piece 11*a* at the left side of the seat cushion. Similarly (FIG. 1), the right leg 17*b* of back frame 16 is pivotally connected at 18*b* to the upper segment 15*b* of the bottom frame piece 11*b* at the right side of the seat cushion.

The side legs 17*a* and 17*b* of the back frame are at the inside of the corresponding bottom frame pieces 11*a* and 11*b*. The bottom frame pieces carry plastic caps 19*a* and 19*b* on the upper ends of their respective upper segments 15*a* and 15*b*. These caps project laterally inward slightly into the respective paths of the legs 17*a* and 17*b* of the back frame when the back frame is raised or lowered, providing a detent action that requires a deliberate effort by a person to either fold or unfold the stadium seat, enough to force the legs 17*a* and 17*b* of the back frame slidably past these end caps.

The back frame legs 17*a* and 17*b* rigidly support a cushioned back rest 20, which extends across the front of these legs, and a rear piece 21, which extends behind these legs. The back frame legs 17*a* and 17*b* are attached to back rest 20 and separately to back piece 21 by screws and they provide a front-to-back spacing between them. The back rest 20 is a front member of the back structure of the stadium seat which will be engaged by the back of a person sitting on the stadium seat. The rear piece 21 is a rear member of the back structure of the stadium seat.

As shown in FIGS. 3 and 7, the right leg 17*b* of the back frame has a flattened upper end 22*b* extending next to the back face of back rest 20. Below this flattened upper end, this leg of the back frame presents an upwardly-facing inclined shoulder 23*b*. (FIG. 7) that extends over to the front face of back piece 21. The left leg 17*a* of the back frame has an identical construction.

Figure 2:
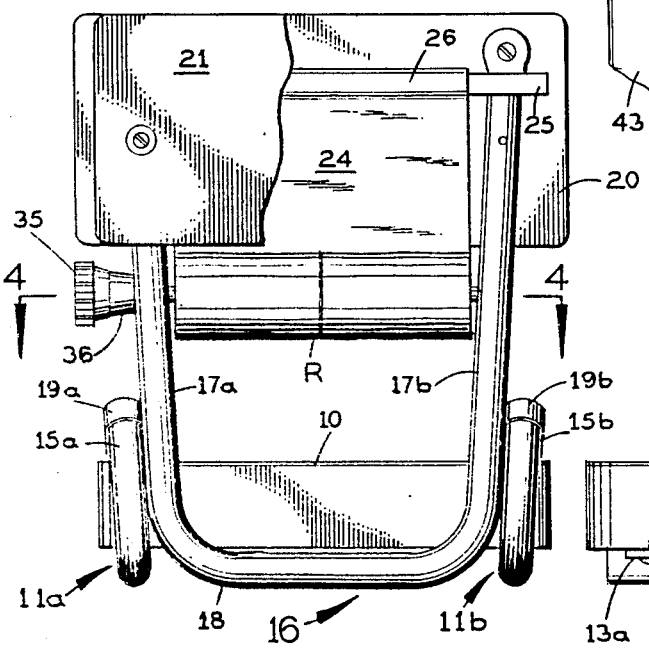
FIG. 2 is a rear elevation of the stadium seat with a part of its back broken away for clarity.

In accordance with the present invention, the side legs 17*a* and 17*b* of the back frame rotatably support a roller holding a rain cover in the form of a web of thin, flexible, water-proof material which is normally wound in a tight roll R (FIGS. 2 and 3) on the roller. An upper part 24 (FIG. 3) of this web extends up from the roll R between the back rest 20 and back piece 21 and between the side legs 17*a* and 17*b* of the back frame of the stadium seat, as best seen in FIG. 2. A wooden stick 25 is snugly received in a loop 26 at the extreme upper end of the web. When the web is rolled down (FIGS. 2 and 3), this stick rests on the upwardly-facing shoulders presented by the side legs 17*a* and 17*b* of the back frame.

As shown in FIG. 4, the rain cover web is wound on a cylindrical roller 30 of a well-known type commonly used in window shades. Roller 30 has a torsion spring 31 inside which is connected at its right end to the ratchet end 32 of the roller and is connected at its left end to a spindle end piece 33 of the roller. The spindle end piece 33 threadedly receives the screw-threaded inner end of a bolt 34 which passes transversely through the side leg 17*a* of the back frame. A knob 35 is affixed to the outer end of bolt 34 and a brake member 36 loosely encircles the bolt between knob 35 and the outer side of side leg 17*a* of the back frame. At the opposite end of the roller, the ratchet mechanism is attached to a flat extension 37 that is closely received in a complementary opening 38 (FIG. 6) in the inner side of the right leg 17*b* of the back frame.

Normally, spring 31 keeps the rain cover wound on roller 30, as shown in FIG. 4, and holds the stick 25 (FIG. 3) down against the upwardly-facing shoulders provided by legs 17*a* and 17*b* of the back fraame. With knob 35 turned to a position in which it does not hold brake member 36 tightly against leg 17*a* of the back frame, the rain cover can be pulled up and unwound from roller 30 by grasping stick 25 at each end and raising it. After the rain cover has been raised, as shown in FIGS. 7 and 8, knob 35 is turned to clamp brake member 36 against side leg 17*a* of the back frame so as to hold the rain cover in its raised position and prevent the torsion spring 31 in the roller from winding it down.

Figure 5:
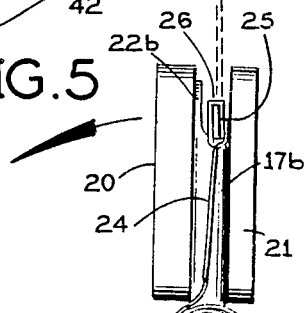
FIG. 5 is a fragmentary perspective view showing the fabric folds of the rain cover at its upper end, with the folds separated in an exaggerated way to facilitate an understanding of the rain cover's construction.

In its rolled-down condition (FIG. 3), throughout its extent both in the roll R and in the upper segment 24 above it the rain cover is folded as shown in FIG. 5, except that in FIG. 5 the successive folds are shown separated for clarity whereas in actuality they are in contiguous face-to-face engagement. Referring to FIG. 5, the rain cover has a back fold 40, opposite outer front folds 41 and 42 respectively joined to the back fold along its opposite longitudinal edges 43 and 44 (which in actuality are narrow edges) and each extending laterally inward almost halfway across the width of the back fold, opposite intermediate front folds 45 and 46 respectively joined to the outer front folds 41 and 42 along their respective inner edges 47 and 48 and extending laterally outward from these edges directly behind the outer front folds 41 and 42, opposite intermediate back folds 49 and 50 respectively joined to the intermediate front folds 45 and 46 along their respective outer edges 51 and 52 and extending laterally inward from these edges immediately in front of the back fold 40, opposite inner back folds 53 and 54 respectively joined to the intermediate back folds 49 and 50 along their respective inner edges 55 and 56, and inner front folds 57 and 58 respectively joined to the inner back folds 53 and 54 along their respective outer edges 59 and 60 and terminating in free inner edges 61 and 62, respectively, that extend along the rain cover near the middle.

When the rain cover is pulled up (FIGS. 7 and 8), it can be unfolded and spread apart laterally as far as necessary to cover the person sitting in the stadium seat. The back fold 40 can extend up across the back, neck and head and forward over the top of the person's head. The flexibility of the rain cover enables it to fit over the shoulders and upper body of the person using it.

I claim:

1. A portable stadium seat comprising:

a seat member;

a pair of bottom frame members attached to said seat member and extending up behind said seat member at laterally spaced locations;

a back structure having a frame with opposite legs having respective connections to said bottom frame members behind said seat member, a back rest attached to and extending across the front of said legs above said connections, and a rear member attached to and extending across the back of said legs, said rear member being spaced behind said back rest;

a roller rotatably mounted on said opposite legs of said frame of the back structure below said back rest and said rear member;

and a flexible folded rain cover wound on said roller and extending up from said roller between said back rest and said rear member of said back structure, said rain cover having a lower end attached to said roller and a free upper end, said rain cover having a retracted position in which its upper end is behind said back rest, said rain cover being adapted to be pulled up from said retracted position and unwound from said roller to an extended position in which its upper end is a substantial distance above said back rest to cover a person sitting on said seat member.

2. A portable stadium seat according to claim 1 and further comprising:

a torsion spring urging said roller rotatably in a direction to hold said rain cover in said retracted position;

and a manually operated brake connected to said roller and engageable with one of said legs of said frame of the back structure to hold said roller against rotation by said spring when the rain cover is in said extended position.

3. A portable stadium seat according to claim 1 wherein:

said back structure presents laterally spaced, upwardly facing shoulders located between said back rest and said rear member and spaced above said roller;

and said rain cover has means on its upper end for engaging said shoulders when said rain cover is in said retracted position.

4. A portable stadium seat according to claim 3 and further comprising:

a torsion spring urging said roller rotatably in a direction to hold said rain cover in said retracted position;

and a manually operated brake connected to said roller and frictionally engageable with the outside of one of said legs of said frame of the back structure to hold said roller against rotation by said spring when the rain cover is in said extended position.

5. A portable stadium seat according to claim 3 wherein:

said rain cover has a loop at its upper end;

and said means on the upper end of said rain cover for engaging said shoulders is a stick received in said loop in the rain cover and projecting laterally beyond the opposite sides of the upper end of the rain cover.

6. A portable stadium seat according to claim 5 and further comprising:

a torsion spring urging said roller rotatably in a direction to hold said rain cover in said retracted position;

and a manually operated brake connected to said roller and frictionally engageable with the outside of one of said legs of said frame of the back structure to hold said roller against rotation by said spring when the rain cover is in said extended position.

7. A portable stadium seat according to claim 6 wherein: said connections of said legs of said frame of the back structure to said bottom frame members are pivotal connections spaced below said roller and enabling said back structure to be folded down on said seat member.

8. A portable stadium seat according to claim 3 wherein: said connections of said legs of said frame of the back structure to said bottom frame members are pivotal connections spaced below said roller and enabling said back structure to be folded down on said seat member.

* * * * *